United States Patent [19]

Sobczyk et al.

[11] 4,419,782

[45] Dec. 13, 1983

[54] FILL-UP INDICATION ARRANGEMENT FOR A VACUUM CLEANER

[75] Inventors: Erhard Sobczyk, Schalksmuehle; Paul-Ulrich Uibel, Ennepetal, both of Fed. Rep. of Germany

[73] Assignee: Vorwerk & Co Interholdung GmbH, Wuppertal, Fed. Rep. of Germany

[21] Appl. No.: 313,752

[22] Filed: Oct. 22, 1981

[30] Foreign Application Priority Data

Oct. 31, 1980 [DE] Fed. Rep. of Germany ..... 3041005

[51] Int. Cl.[3] ..... A47L 9/19; G01L 7/08

[52] U.S. Cl. ..... 15/339; 55/274; 55/DIG. 34; 116/268

[58] Field of Search ..... 15/339; 55/274, DIG. 34; 116/268, 270

[56] References Cited

U.S. PATENT DOCUMENTS

| | | | |
|---|---|---|---|
| 3,934,543 | 1/1976 | Howard | 55/274 X |
| 4,193,292 | 3/1980 | Simonsson | 116/268 X |
| 4,195,383 | 4/1980 | Leinfelt | 15/339 |
| 4,330,900 | 5/1982 | Dörr et al. | 15/339 |

FOREIGN PATENT DOCUMENTS

| | | | |
|---|---|---|---|
| 547664 | 6/1977 | U.S.S.R. | 116/268 |

*Primary Examiner*—Chris K. Moore

*Attorney, Agent, or Firm*—Michael J. Striker

[57] ABSTRACT

A fill-up indication arrangement for a vacuum cleaner includes a diaphragm adapted to move up and down in response to a pressure build-up in the vacuum cleaner and an indicator disc connected to the diaphragm through a pivotable gear sector and a stop on the indicator disc, which stop engages with the teeth of the gear sector when the indicator disc takes its angular position thus indicating that a filter bag contained in the vacuum cleaner is full and should be replaced.

3 Claims, 3 Drawing Figures

FILL-UP INDICATION ARRANGEMENT FOR A VACUUM CLEANER

BACKGROUND OF THE INVENTION

The present invention relates to vacuum cleaners, and more particularly, to a fill-up indication arrangement for use with a vacuum cleaner.

There are known in the art fill-up indication arrangements used in vacuum cleaners and operative for indication of the conditions that a filter bag contained in the vacuum cleaner is filled up. Such an arrangement is, for example, disclosed in a German Gebrauchsmuster publication DE-GM No. 69 20 047. The published disclosure describes a fill-up indication device which includes an up-and-down movable diaphragm which turns an indicator disc via a screw threadable into a nut positioned in the disc.

This otherwise satisfactory device fails, however, to reliably protect the movement translation means against contamination which penetrates the thread of screw-nut connection. A further disadvantage of the known arrangement is that in a switch-off condition of the device, when no under-pressure in the vacuum cleaner occurs, the indicator disc may inadvertently return to its jumping-off position (the indication is O.K.).

SUMMARY OF THE INVENTION

It is an object of the invention to provide an improved fill-up indication arrangement for a vacuum cleaner.

Another object of this invention is to provide a fill-up indication arrangement with a movable diaphragm and turnable indicator disc, which effectively protects the movement-translation means of the arrangement against contamination and, thus, permits one to preserve a fill-up indication value.

Still another object of the invention is to provide a fill-up indication arrangement which informs a user about a filled-up condition of a filter bag even in a shut-off position of the vacuum cleaner.

These and other objects of the invention are attained by a fill-up indication arrangement for a vacuum cleaner comprising a diaphragm movable in upward and downward directions in response to a pressure build-up in the vacuum cleaner; a turnable indicator disc operatively connected to said diaphragm and adapted to move in response to the movement of said diaphragm; and an angular gearing interconnected between said diaphragm and said disc to translate the movement of said diaphragm into the movement of said indicator disc.

The angular gearing may include a pivotable gear sector provided with teeth and cooperating with said diaphragm and a rod-like stop carried by said indicator disc, said teeth being engageable with said stop.

The arrangement may include a base supporting the diaphragm, and a pivot mounted in said base, said gear sector being adapted to pivot about said pivot.

The indicator disc may be provided with a plurality of locking teeth positioned along a circular track in a spaced relationship with one another on the surface of said disc.

The arrangement may further comprise additional locking means including an elongated lever formed with a counter-locking tooth at one end thereof, the counter-locking tooth being engageable with the locking teeth on the disc.

The locking means further include a pivotable angular lever connected to a second end of said elongated lever and adapted upon its pivoting movement to release said counter-locking tooth of the elongated lever form the locking teeth of the disc.

The elongated lever may be provided with a sloped surface formed thereon between said one end and said second end thereof, said base having an extension with an edge, said sloped surface running against said edge when said elongated lever is released from said locking teeth.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENT

Figure 1:
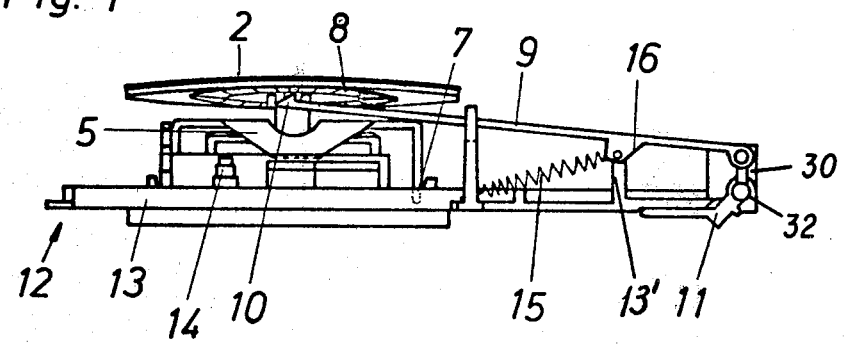
FIG. 1 is a side view of a fill-up indication arrangement in accordance with the invention.
Figure 2:
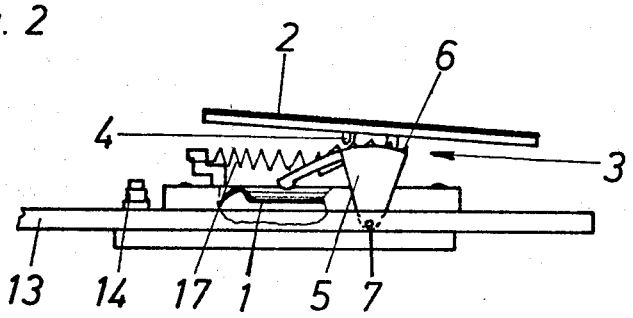
FIG. 2 is a view of FIG. 1 turned over 90°.

FIGS. 1 and 2 illustrate two views of a fill-up indication arrangement generally denoted as 12. The arrangement includes a chassis or base portion 13 on the upper surface of which a diaphragm 1 is positioned. The diaphragm 1 is located between an underpressure (internal pressure) space of the vacuum cleaner above chassis 13, and an ambient pressure space below chassis 13. The diaphragm 1 is adapted to move upwardly and downwardly in response to a pressure differential of internal and external pressures.

As seen in FIG. 2, the diaphragm 1 is connected to a gear sector 5 which is provided with teeth 6 and is adapted to pivot about an axle 7. The arrangement 12 includes an indicator disc 2 mounted in the cover of the vacuum cleaner which has a centrally positioned axle 18 downwardly projecting from the lower surface of the indicator disc (shown in FIG. 3) and a rod-like stop 4 also extending in a downward direction from the lower surface of the indicator disc.

Rod-like stop 4 is adapted to engage or disengage the teeth of the gear sector 5. The indicator disc 2 is further provided with a number of teeth 8 disposed along a circular track on the lower surface of the indicator disc 2. The stop 4 and the sector 5 constitute an angular gearing 3.

The arrangement according to the invention further comprises a lever 9 whose end is formed with a counter-locking tooth 10 engageable with locking teeth 8 on the indicator disc 2. The intermediate portion of lever 9 has a sloped surface 16 and is connected to the chassis portion 13' by a biasing spring 15. Another end of the lever 9 is connected to an angular lever 11 which in turn is connected to a cover of the vacuum cleaner (not illustrated herein).

The gear sector 5 is in turn biased by a spring 17.

In operation, when the internal pressure is increased as a filter bag is filled up, the diaphragm 1 becomes curved in an upward direction and thus moves the gear sector 5. The latter pivots about the axle 7 and teeth 6 of the gear sector engage with the rod-like stop 4 thus causing the pivoting or turning of the indicator disc 2.

In order to prevent the situation that indication could not be read out in a switch-off condition of the device when no underpressure is available, an additional lock arrangement is provided in the fill-up indicator. This lock arrangement includes the above-mentioned locking teeth 8 and levers 9 and 11 connected to each other by a link 30. When the counter-locking tooth 10 of lever 9 engages the teeth 8 of the disc 2 the latter is held in its locked position.

The lever 11 is illustrated in the position when the cover (not shown) covering the dust space is in its closed condition. In this position lever 11 holds lever 9 with its counter-locking tooth 10 in a locked position. If now indication shows that a filter-bag contained in the vacuum cleaner is full and a user thus opens the cover, the angular lever 11, which is no longer held in the position of FIG. 1 by the cover, will be released, and will, in turn, release lever 9 which by force of spring 15 will move to the left (on the plane of the drawing). As the released angular lever 11 pivots about its pivot point 32 in the downward direction, lever 9, which is no longer held in the locked position by lever 11, will, with its sloped surface 16 running against the edge of a projection 13', slip over projection 13' in the downward direction whereby the additional lock becomes released due to disengaging the tooth 10 from the locking teeth 8. When the lock is released, the indicator disc 2 is urged by the spring 17 into its initial position inasmuch as spring 17 pulls the gear sector 5 counterwise and the indicator disc 2 is therefore brought into its initial position by the angular gearing 3.

Figure 3:
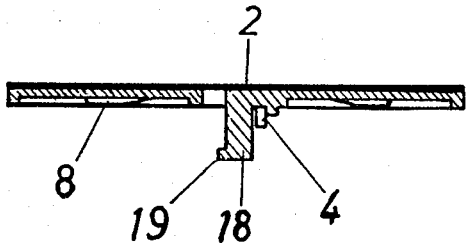
FIG. 3 is a sectional view through an indicator disc of the invention.

As seen in FIG. 3 the central axle 18 of the indicator disc is provided with a projection 19 which serves for preventing slipping of the disc 2 out from corresponding guideways normally provided on the vacuum cleaner.

It will be understood that each of the elements described above, or two or more together, may also find a useful application in other types of fill-up indication arrangements for vacuum cleaners differing from the types described above.

While the invention has been illustrated and described as embodied in fill-up indication arrangements for vacuum cleaners, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A fill-up indication arrangement for a vacuum cleaner with an insertable filter bag, comprising a diaphragm mounted on a base in said cleaner communicating on one side thereof with the interior of the filter bag and with the exterior of the vacuum cleaner on the other side thereof and movable in upward and downward directions in response to the change in pressure differential between the interior of the filter bag and the exterior of the vacuum cleaner; a turnable indicator disc operatively connected to said diaphragm and adapted to move in response to the movement of said diaphragm; an angular gearing interconnected between said diaphragm and said disc to translate the movement of said diaphragm into the movement of said indicator disc, said angular gearing including a pivotable gear sector mounted on an axle on said base provided with teeth and cooperating with said diaphragm and a rod-like stop carried by said indicator disc, said teeth being inter engageable with said stop; said gear sector being adapted to pivot about said axle in response to movement of said diaphragm; said indicator disc being provided with a plurality of locking teeth positioned along a circular track in a spaced relationship with one another on the surface of said disc; and additional locking means including an elongated lever formed with a counter-locking tooth at one end thereof, said counter-locking tooth being engageable with said locking teeth.

2. The arrangement of claim 1, wherein said locking means further include a pivotable angular lever connected to a second end of said elongated lever and adapted upon pivoting movement to release said counter-locking tooth of said elongated lever from said locking teeth.

3. The arrangement of claim 2, wherein said elongated lever is provided with a sloped surface formed thereon between said one end and said second end thereof, said base having an extension with an edge, said sloped surface running against said edge when said elongated lever is released from said locking teeth.

* * * * *